United States Patent [19]

Adams

[11] 3,939,781

[45] Feb. 24, 1976

[54] INCINERATOR, INCINERATION SYSTEM AND METHOD

[75] Inventor: Jack C. Adams, York, Pa.

[73] Assignee: Ecologenics Corporation, Red Lion, Pa.

[22] Filed: May 30, 1974

[21] Appl. No.: 474,796

[52] U.S. Cl. ..... 110/8 C; 110/8 P; 110/15; 110/119

[51] Int. Cl.[2] ..... F23G 5/12

[58] Field of Search ..... 110/7 R, 8 R, 8 A, 8 C, 110/10, 15, 8 P, 119

[56] References Cited

UNITED STATES PATENTS

| | | | |
|---|---|---|---|
| 2,537,467 | 1/1951 | Komline | 110/8 R |
| 3,358,623 | 12/1967 | Lenz et al. | 110/10 |
| 3,628,473 | 12/1971 | Maille | 110/8 |
| 3,725,538 | 4/1973 | Brewer | 110/8 |
| 3,734,036 | 5/1973 | Abos | 110/15 |
| 3,736,111 | 5/1973 | Gardner et al. | 110/8 X |
| 3,822,653 | 7/1974 | Ghelfi | 110/8 C |
| 3,823,677 | 7/1974 | Polsak | 110/8 C |

*Primary Examiner*—Kenneth W. Sprague

[57] ABSTRACT

Comminuted waste material is inserted into an upper section of a vertically directed incinerator. The incinerator includes a plurality of vertically contiguous zones. A blower is connected to an outlet port of the incinerator to adjust the flow rate of combusting gases within each of the incineration zones. The blower provides a force on the combusting gases opposite to a thermal updraft force which permits control of the flow of the gases in a manner resulting in spontaneous combustion of the waste material.

27 Claims, 5 Drawing Figures

FIG. 2
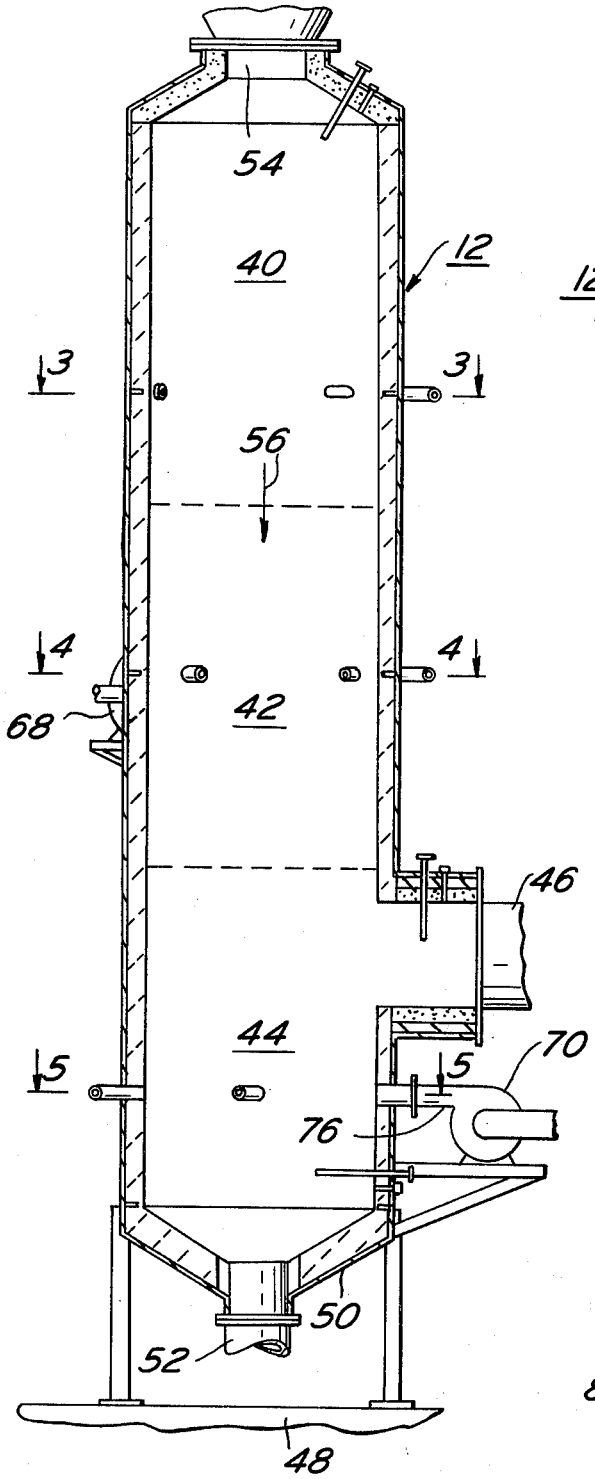
FIG. 3
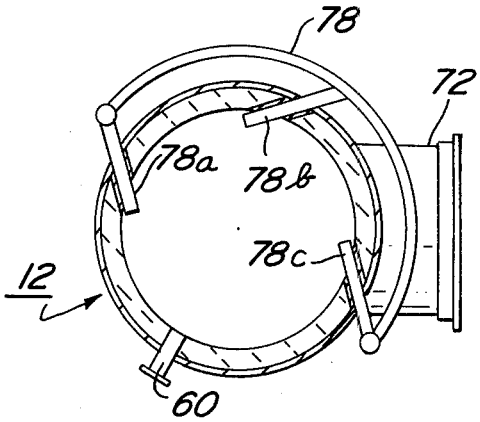
FIG. 4
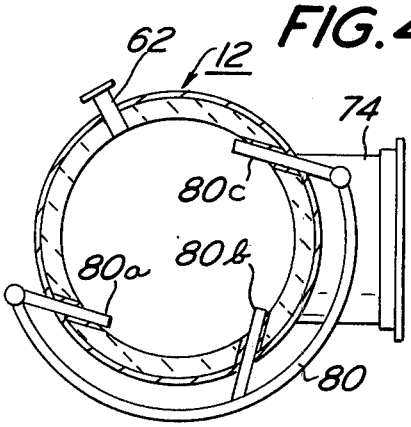
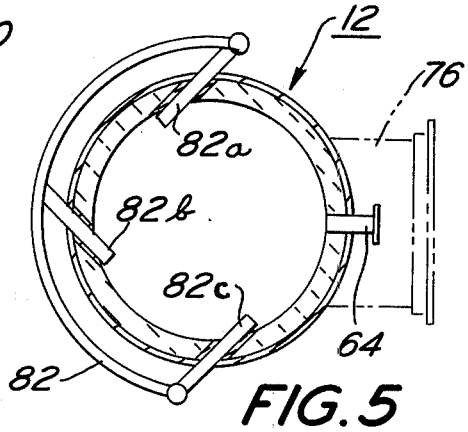
FIG. 5

INCINERATOR, INCINERATION SYSTEM AND METHOD

BACKGROUND OF THE INVENTION

A. Field of the Invention

This invention pertains to the field of incineration. In particular this invention relates to incinerator systems to provide spontaneous combustion of waste material within an incinerator.

B. Prior Art

Incineration systems and methods of incinerating waste materials are known in the art. However, in many systems incineration is accomplished by continuous burning of fuel fired burners which results in the use of excessive amounts of fuel. This use of fuel results in high incineration operating costs as well as an undesirable drain of fuel resources.

In some incinerator systems, combustion is accomplished in a vertically directed chamber. However, in many such type incineration systems the rate of flow of combustion gases is uncontrolled. Thus, large quantities of uncombusted waste material is derived from these systems as an unwanted by-product. Such uncombusted waste material results in a low operating efficiency of these incinerator systems.

In other vertically directed incineration chambers, large quantities of excess air must be incorporated to promote burning of the waste material. Such incorporation of excess air increases the operation costs of the incineration system. Further, such incorporation of excess air often has the effect of providing uncontrolled burning of the waste material and results in portions of the waste material remaining in an uncombusted state.

Summary of the Invention

A waste material incineration method which initially includes the step of comminuting the waste material to a predetermined size. The comminuted waste material is then inserted into a vertically extending incinerator. The flow rate of the waste material combustion gases is adjusted through a plurality of vertically contiguous zones within the incinerator to provide spontaneous combustion of the comminuted waste material within the incinerator.

BRIEF DESCRIPTION OF THE DRAWINGS

FIG. 2 is a section elevation view of the incinerator showing an initial combustion zone, a second combustion zone, and a third combustion zone;

FIG. 3 is a sectional view of the incinerator taken along the section line 3—3 of FIG. 2;

FIG. 4 is a sectional view of the incinerator taken along the section line 4—4 of FIG. 2; and FIG. 5 is a sectional view of the incinerator taken along the section line 5—5 of FIG. 2.

DESCRIPTION OF THE PREFERRED EMBODIMENTS

Figure 1:
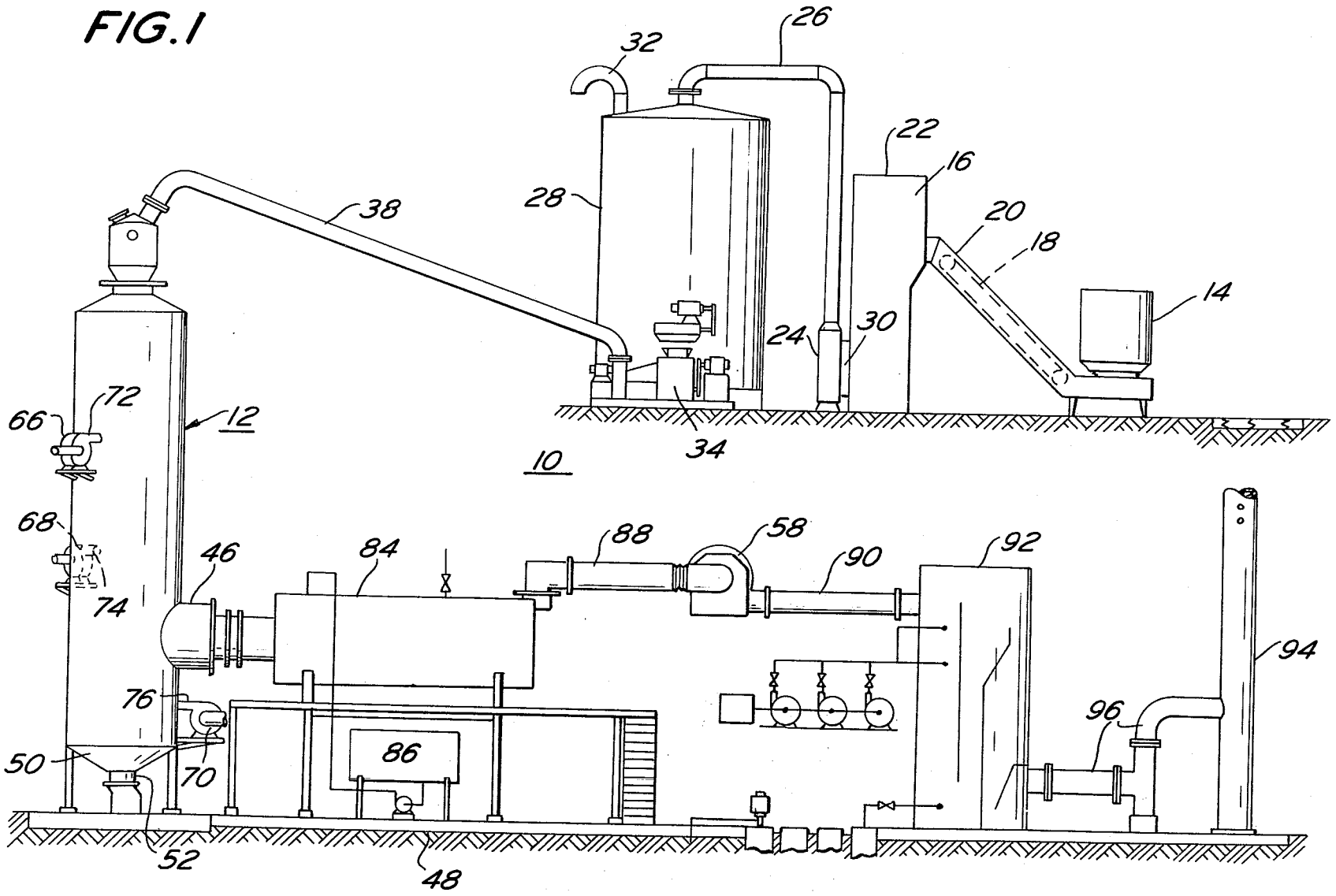
FIG. 1 is a schematic view of the incineration system showing the flow of the waste material from insertion into a receiving bin to exhaust of waste gases to an external environment.

Referring now to FIG. 1, there is shown waste disposal system 10 for use in disposing of residential, commercial, as well as industrial refuse. In overall concept, system 10 promotes rapid incineration of a suspension of waste material within refractory lined incinerator 12 and results in substantially complete combustion of the waste material combustible components. System 10 further utilizes the gaseous waste heat emitted from incinerator 12 to generate steam within boiler 84. As part of system 10, waste gases are then cleansed before insertion into the external environment. Incorporation of the waste material into vertically directed incinerator 12 and associated incineration of the refuse or waste material in suspension throughout its passage within incinerator 12 by controlled gravity assist provides for spontaneous combustion of the inserted waste material. This combustion technique allows a minimum amount of excess air to be inserted within incinerator 12 for combustion purposes which effectively minimizes problems associated with resulting contamination of the external environment.

As shown in FIG. 1, waste material or refuse is initially incorporated into receiving bin 14 for transport to primary shredder 16. The waste material is moved between bin 14 and shredder 16 on endless conveyor 18 passing within bin conduit 20. The waste material passes internal to primary shredder housing 22 at an upper portion thereof to provide storage volume for the incoming waste material. Primary shredder 16 reduces the waste material particles to a maximum of approximately 3 inch lengths. Primary shredder 16 may be of the hammer-type mill, one of which is produced by the Bryant-Poff Corporation having a designation of Model No. 50X36 Big-Pro Shredder or some like shredding device not important to the inventive concept as herein detailed.

The waste material now residing in primary shredder 16 and having a size nominally less than 3 inches in length is drawn from primary shredder 16 by shredder blower 24 to be passed through blower conduit 26 into silo 28. Shredder blower 24 is connected to a lower section of primary shredder housing 22 through blower insert piping 30 to provide a continuous through passage from a lowermost section of primary shredder 16 to an upper section of silo 28. Shredder blower 24 may be of the centrifugal type which is well known in the art and may be the same type used on the previously referenced No. 50X36 Big-Pro Shredder produced by Bryant-Poff.

Waste material having been initially shredded in primary shredder 16 is then inserted into an upper portion of silo 28 which may be used as a storage area prior to insertion within incinerator 12. Waste material entering silo 28 passes to an equilibrium position by gravity assist. Silo 28 includes vent pipe 32 which is connected to a trap for collection of possible waste material particles that are being driven into silo 28 at a high pressure. Vent pipe 32 and an associated trap (not shown), which are not part of the inventive concept are utilized to prevent contamination of the external environment. Secondary shredder 34 is connected to an internal portion of a lower section of silo 28 to provide secondary comminution of the waste material residing within the storage area of silo 28. Secondary shredder 34 has as its purpose to provide a second comminution of the waste material which results in the waste material having a size nominally less than 1 inch. Secondary shredder 34 is well known in the art, one such type having been successfully used is the Bryant-Poff Model No. 3600-25. Secondary shredder blower 36 provides the necessary pressure differential to transport the now twice comminuted waste material through incinerator conduit 38 into vertically extending incinerator 12.

Secondary shredder blower 36 may be the same centrifugal type used on the No. 3600-25 shredder 34, or some like device.

The finely divided particles of waste material are now inserted into an uppermost portion of vertically displaced incinerator 12. In overall concept, the particulates are spontaneously combusted in their passage through three major zonal areas within incinerator 12. The waste material particles pass through initial combustion zone 40, second combustion zone 42, and third combustion zone 44 before the heated combustion gases exit from incinerator 12 through side outlet port 46 as is shown in FIGS. 1 and 2. In general, incinerator 12 vertically extends above ground 48 in order to provide gravity assist for the waste material particles being combusted in suspension throughout combustion zones 40, 42, and 44. Incinerator 12 may include conically shaped floor 50 and associated ash removal port 52 to facilitate discharge of ash products from incinerator 12. Ash removal may be provided by passage of resulting ash through ash removal port 52 into a storage bin which may be removed at the completion of any particular cycle, however, such is not important to the inventive concept as is herein detailed. The internal walls of incinerator 12 is in general lined with high temperature refractory brick which can withstand the elevated temperatures resulting during the combustion process.

After initially elevating the interior volume of incinerator 12 (to be discussed in following paragraphs), the waste material enters incinerator 12 through upper port 54 and falls into initial combustion zone 40 where it begins to spontaneously combust and is heated into a first elevated temperature range. In actual practice, the temperature measurements within initial combustion zone 40 have been maintained within an approximating range of 1750° – 1920°F. The initially combusting waste material then passes into second combustion zone 42 in the direction of gravity vector 56 through gravity assist. The combusting products are heated further into a temperature range higher than those found in the initial combustion zone 40. Actual tests have shown that second combustion zone 42 temperatures are in the neighborhood of 2000°F. The increase of temperature of the combusting products has been found to give rise to thermal currents which displace the combusting gases upward in a direction opposing gravity vector 56 to provide some reentrance of the combustion gases into initial combustion zone 40.

It is believed that the rise of gases within second combustion zone 42 into initial combustion zone 40 results from natural convection currents. Such displacement or transport of the combustion gases in an upward direction is important to the inventive concept since the flow of gases through side outlet 46 may now be rigidly controlled through actuation of downstream blower 58 which is further described in following paragraphs. It is believed that the up draft of combustion gases from second combustion zone 42 into initial combustion zone 40 provides for a means whereby there is one force in the direction of gravity vector 56 acting on the combusting gases, namely, the gravity force which acts in combination with an opposing updraft force provided by the differences in temperature between zones 40 and 42. Thus, where a pressure differential is applied by blower 58, there is now an additional downward force acting on the combusting gases. The blower force acting in concert with the gravity force but opposite to the convection force permits control of the flow rate of the suspended waste material gases to provide each of zones 40, 42 and 44 with a predetermined temperature range which results in spontaneous combustion.

After passage of the combusting particles through initial and second combustion zones 40 and 42 which serve as an overall primary combustion zone, the remaining combusting gases pass into third combustion zone 44 which may serve as a secondary combustion zone. Temperatures being measured in third combustion zone 44 have been found to be somewhat lower than temperature range within initial and second combustion zones 40 and 42. Temperature ranges in third combustion zone 44 for one design of incinerator 12 have been found to be within an approximate range of 1300° to 1550°F.

By providing a vertically extended incinerator 12 through which waste material passes from an upper port 54 to a lower side outlet port 46 in combination with one combustion zone 42 at a higher temperature than another combustion zone 40 temperature, a thermodynamic environment is created whereby gas transport forces may act in opposing directions. When this combination of forces is then acted on by a pressure differential provided by blower 58, shown in FIG. 1, a controlling mechanism is set up whereby the flow rate and the temperatures in each of the zones 40, 42 and 44 may be adjusted to provide spontaneous combustion with a minimum insert of excess air.

It will be noted that where specific combustion zones and the maintenance of particular temperatures therein is not controlled, there would be the tendency to obtain a high temperature in an upper portion of incinerator 12. The gases would then pass to a lower portion of incinerator 12 only through gravity assist. This would not provide a controlled displacement for the movement of the combusting gases. Such an arrangement would necessarily not provide for complete combustion of the waste material and at best would require excessive amounts of air being inserted into incinerator 12 to provide combustion.

Within each of combustion zones 40, 42 and 44, there is provided a means whereby the interior of incinerator 12 may be initially heated into a temperature range approximating 1800°F. to provide an environment where the incoming waste material may begin to spontaneously combust. As is shown in FIGS. 3, 4 and 5, initial oil burner 60, second oil burner 62, and third oil burner 64 associated respectively with combustion zone 40, 42 and 44 are inserted through a sidewall of incinerator 12 to provide the initial heating of the internal volume. Oil burners 60, 62 and 64 are well known in the art and such may be York-Shipley burners having a Model No. FV20B-2. Additionally, each of zones 40, 42 and 44 include supplementary or excess air blowers 66, 68 and 70 as is shown in FIG. 1. Each of supplementary air blowers 66, 68 and 70 are mounted to external wall of incinerator 12 and pass air through respective conduits 72, 74 and 76. Looking at the initial combustion zone 40 air supply, it is seen that air is taken through a main excess air conduit 78 passing around the periphery of a sidewall of incinerator 12 and extending throughout a substantial segment thereof. Connected to main excess air conduit 78 is a plurality of subsidiary air pipes **78*a*, 78*b* and 78*c* which pass through a sidewall of incinerator 12 and are angled with respect thereto to provide vortexing of the incoming air. In like manner, air insert piping 80*a*, 80*b*** and 80*c* provide vortexed incoming excess air into second combustion zone 42. Similarly, air excess conduits 82*b*, 82*c* and 82*a* provide vortexed air inlet into third combustion zone 44. The vortexing of the air has been found to aid in the combustion of the waste materials in a twofold manner: (1) by creating turbulence to increase heat transfer throughout the combusting particles in each of the combustion zones; and (2) by providing movement of the combusting particles within each of the combusting zones to achieve more homogeneous burning in a zone. Each of blowers 66, 68 and 70 are well known in the art and may be of the type produced by the Lau Corp. having a model No. HPR-12.

The resulting exhaust gases pass through outlet port 46 of incinerator 12 to boiler 84 to provide waste heat recovery. One such type boiler 84 which has been used successfully is the York-Shipley series 596 heat exchanger rated at 700 horsepower. Boiler 84 may include feed water pump 86 which is well known in the art.

The exhaust gases after passing through boiler 84 enter boiler conduit 88 to be drawn into blower or fan 58. Blower 58 may be of the induction type produced by Buffalo Forge Corp. and having a designation Size 60, Type MW. In actual practice induction fan 58 produces up to 0.5 inch pressure drop within incinerator 12.

By empirically adjusting the pressure drop for blower 58, the rate of flow of combustion gases through incinerator 17 may be adjusted as has been described. This flow rate may be utilized to maintain predetermined temperatures within each of combustion zones 40, 42 and 44 to provide spontaneous combustion. Thus, by downstream actuation of a pressure drop, the spontaneous combustion of the waste material internal to incinerator 12 is maintained.

Exhaust gases pass through appropriate piping 90 to scrubber unit 92 in order to cleanse the waste gases of harmful emissions. Scrubber unit 92 may be of the baffled spray type, one such type being commonly used and well known in the art is produced by Chemical Equipment Co. The cleansed waste material passing from scrubber unit 92 is then brought into stack 94 through associated contour piping 96 and exhausted to the external environment.

What is claimed is:

1. A waste material incineration method including the step of:

a. comminuting said waste material to a predetermined size;

b. inserting said comminuted waste material to a vertically extending incinerator; and c. applying a pressure differential to said incinerator throughout said vertical extension of said incinerator to control a flow rate of said comminuted waste material combustion gases through a plurality of vertically contiguous zones within said incinerator to provide spontaneous combustion of said comminuted waste material within said incinerator.

2. The method of waste material incineration as recited in claim 1 where the step of applying said pressure differential to said incinerator includes the step of maintaining a predetermined temperature in each of said incinerator zones whereby said comminuted waste material is spontaneously combusted.

3. The method of waste material incineration as recited in claim 2 where the step of maintaining said predetermined temperature includes the step of inserting a predetermined flow rate of air into said incinerator zones.

4. The method of waste material incineration as recited in claim 2 where the step of maintaining said predetermined temperature includes the step of applying a force to said combusting material in the direction of a gravity vector to oppose an updraft force applied to said combusting material in a direction opposing said gravity vector.

5. The method of waste material incineration as recited in claim 4 where said gravity vector force is greater than said force in said direction opposing said gravity vector.

6. The method of waste material incineration as recited in claim 1 where the steps of: comminuting said waste material includes the step of initially shredding said waste material to a predetermined initial size, and; storing said initially shredded waste material in a chamber.

7. The method of waste material incineration as recited in claim 6 where the step of initially shredding is followed by the step of passing said waste material through a secondary shredder for reducing said initial size of said waste material prior to said insertion within said incinerator.

8. The method of waste material incineration as recited in claim 1 where said comminuted waste material is inserted into an uppermost section of said vertically extending incinerator.

9. The method of waste material incineration as recited in claim 1 including the step of passing the resulting gases of said combusted waste material through a boiler for producing steam.

10. The method of waste material incineration as recited in claim 1 including the step of drawing said resulting gases of said combusted waste material into a gas scrubber for removing contaminents from said combusted waste material gases.

11. The method of waste material incineration as recited in claim 10 where the step of drawing said resulting gases into said gas scrubber is followed by the step of exhausting said gases to an external environment.

12. An incinerator for combusting waste material, comprising:

a. waste material combustion means forming a vertically extending enclosed chamber having a plurality of vertically contiguous combustion zones; and, b. means for applying a predetermined pressure differential across said contiguous combustion zones within said combustion means for controlling a flow rate of said combusting waste material through said combustion zones to provide spontaneous combustion of said waste material within said combustion means.

13. The incinerator as recited in claim 12 where said pressure differential means includes means for applying a force to combusting waste material gases in a direction substantially coincident with a gravity vector.

14. The incinerator as recited in claim 13 where said force being applied to said combusting waste material gases in said direction coincident with said gravity vector is opposed by a thermal updraft force acting on said combusting waste material gases.

15. The incinerator as recited in claim 12 where said pressure differential means includes blower means connected to an outlet port of said combustion means located in a lower section thereof, said blower means for creating a negative pressure differential across said combustion zones.

16. The incinerator as recited in claim 15 where said blower means applies a downwardly directed force to said combustion waste material gases, said downwardly directed force substantially opposing a thermal updraft force being applied to said combusting gases within said enclosed chamber.

17. The incinerator as recited in claim 12 where said waste material combustion means includes means for elevating said chamber combustion zones to a temperature substantially equal to a combustion temperature of said waste material prior to the insertion of said waste material within said combustion means.

18. The incinerator as recited in claims 17 where said temperature elevation means includes burner means within each of said vertically contiguous zones of said enclosed chamber.

19. The incinerator as recited in claim 12 where said waste material combustion means includes means for inserting excess air into each of said combustion zones for aiding in the maintenance of a predetermined temperature in each of said zones.

20. The incinerator as recited in claim 19 where said excess air means includes means for vortexing said inserted air in a direction normal to a gravity vector within said enclosed combustion chamber.

21. A waste material incineration system comprising:

a. means for comminuting said waste material to a predetermined size;

b. incinerator means connected to said comminution means for receiving said comminuted waste material at an upper section; and, c. means for adjusting a flow rate of said comminuted waste material combustion gases through a plurality of vertically contiguous zones within said incinerator means by applying a predetermined pressure differential across said contiguous zones for providing a thermodynamic environmental condition receptive to spontaneous combustion of said comminuted waste material.

22. The waste material incineration system as recited in claim 21 where said flow rate adjustment means includes means for maintaining a predetermined temperature within each of said contiguous zones within said incinerator means.

23. The waste material incineration system as recited in claim 22 where said temperature maintenance means includes means for applying a force to said combusting material gases in a direction coincident with a gravity vector to oppose a thermal updraft force applied to said combustion waste material gases.

24. The waste material incineration system as recited in claim 21 including boiler means connected to a lower section of said incinerator means for passing combusted waste material gases therethrough to produce steam.

25. The waste material incineration system as recited in claim 24 including blower means connected to said boiler means for: (1) drawing said combusted waste material gases through said boiler, and (2) applying a predetermined pressure differential across said contiguous zones within said incinerator means.

26. The waste material incineration system as recited in claim 21 where said incineration means includes means for elevating temperatures, prior to the insertion of said waste material, within each of said contiguous zones to a predetermined temperature range to provide spontaneous combustion of said waste material.

27. The waste material incineration system as recited in claim 26 where said temperature elevation means includes burner means within each of said contiguous zones.

* * * * *